United States Patent [19]

Weckesser

[11] Patent Number: 4,653,224

[45] Date of Patent: Mar. 31, 1987

[54] CHRISTMAS TREE IRRIGATION DEVICE

[76] Inventor: Elden C. Weckesser, 639 Coal Bank Rd., Doylestown, Ohio 44230

[21] Appl. No.: 813,527

[22] Filed: Dec. 26, 1985

[51] Int. Cl.[4] ..... A47G 33/12

[52] U.S. Cl. ..... 47/40.5; 47/79

[58] Field of Search ..... 47/79–81, 47/40.5

[56] References Cited

U.S. PATENT DOCUMENTS

| | | | |
|---|---|---|---|
| 1,117,474 | 11/1914 | Benning | 47/79 |
| 1,453,401 | 5/1923 | Mattson | 47/80 X |
| 2,183,970 | 12/1939 | Meissl | 47/80 |
| 2,799,121 | 7/1957 | Modeweg | 47/80 |
| 2,938,304 | 5/1960 | Thomas et al. | 47/40.5 X |
| 3,137,969 | 6/1964 | Sokol | 47/79 X |
| 3,469,342 | 9/1969 | Morris | 47/40.5 |
| 3,697,026 | 10/1972 | Hambrick | 47/40.5 X |
| 4,121,608 | 10/1978 | MacLeod | 47/79 X |
| 4,148,155 | 4/1979 | Allen | 47/79 X |

FOREIGN PATENT DOCUMENTS

| | | | |
|---|---|---|---|
| 2053528 | 5/1972 | Fed. Rep. of Germany | 47/80 |
| 1024483 | 4/1953 | France | 47/80 |
| 1139029 | 1/1969 | United Kingdom | 47/79 |

*Primary Examiner*—Robert E. Bagwill

[57] ABSTRACT

A Christmas tree irrigating device for supplying water to an open cup around the base of such tree, said device consisting essentially of a water reservoir and a conduit into said cup, said conduit comprising flexible tubing that terminates in an inlet tube for deep penetration into said cup, said inlet tube being crush-resistant and equipped with means for holding it in place inside said cup.

2 Claims, 11 Drawing Figures

CHRISTMAS TREE IRRIGATION DEVICE

This invention relates to a stand assembly for a Christmas tree or the like and more particularly to one where a cut tree or cut portion of a tree (e.g. a cut-off limb or tip) can be irrigated with water. It should be understood that "water" is meant here to include nutrient, preservative, and fire-retardant solutions as well as plain water.

Heretofore many Christmas tree stands and holders have been offered, some which come apart for storage and many which hold some water in a cavity or cup around the bottom of the severed tree portion. Some free trees can absorb as much as a couple of quarts of water daily, and keeping them irrigated is thought to be very desirable.

Advantages of the instant invention over various prior proposals include: convenient and comfortable tree irrigation controlled remotely; a subcombination reservoir and water-feeding tube which is adapted to irrigate many conventional types of conventional tree stands remotely and attach thereto or to the tree base portion therein for secure use as the instant assembly; and the subcombination of a tree-holding stand with water cavity therein for contact with the tree base, such stand having, however, an inlet tube for water which reaches near to the bottom of such cavity and is attachable to a flexible water conduit to a remote water reservoir for use as the instant assembly. Thus, the instant invention can be furnished to the user as an assembly ready to take care of the tree; or simply as a tree holder section which can be connected readily with a flexible hose to a preexisting water reservoir that can be raised and lowered; or even more simply as a reservoir and flexible tubing that can be used with a preexisting tree stand that has a water-holding cavity in it for irrigating the tree.

BROAD STATEMENT OF THE INVENTION

The irrigating stand assembly aspect of this invention comprises: a tree-holding stand section having a cavity for receiving the base of a severed tree or portion of a tree, said cavity being capable of retaining an initial volume of water in contact with said base, a container adjustable as to elevation for holding a reserve volume of water for said cavity but apart therefrom; and a flexible water conduit for interconnecting a volume of water in said cavity with a volume of water in said container.

The stand section subcombination aspect of the invention includes an inlet tube integral with or separatable from said water cavity in the stand, said tube reaching near to the bottom of said cavity.

The reserve container and conduit subcombination aspect of the invention includes a container with a flexible conduit for water leading therefrom, and the other end of said conduit has a fastener for attachment to the tree base or to the stand.

DESCRIPTION OF THE DRAWINGS

FIGS. 8 and 9 are in horizontal cross section.

Figure 1:
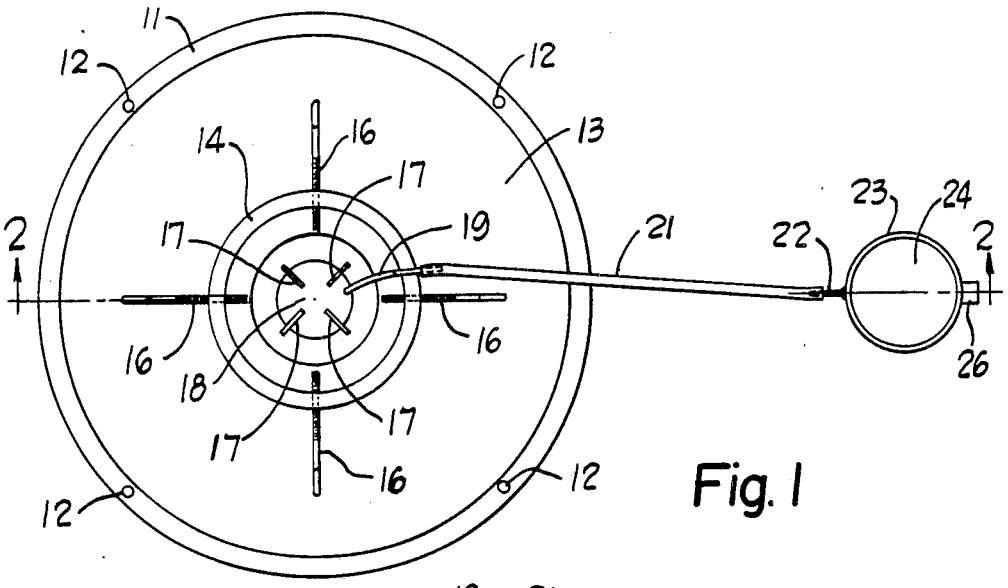
FIG. 1 shows a preferred embodiment of applicant's assembly in plan view.

Looking particularly at FIG. 1, moulded plastic Christmas tree stand ("Stand'em Tall" brand, the trademark of Emsco Group, Girard, Pa.) has a 19½" diameter base ring 11 equipped with holes 12 for attaching the stand to the floor, table, or the like. Frustoconical outer wall 13 reaches up to annular top 14 just below which are screwed four equally-spaced eyebolts 16 for securing the tree trunk to the stand. A broadly flower pot-shaped cavity for receiving the severed tree base and water for the tree extends from top 14 down to cavity bottom 18 with a slight change in slope indicated at the circle between top 14 and bottom 18.

At the corner of bottom 14 and the side wall of the cavity are 4 equally-spaced triangular braces 17 molded into the stand to guide the tree base and restrict its turning.

Steel inlet tube 19 reaches to near the bottom of the water cavity of the stand and generally conforms to the wall of such cavity as it reaches downward. The stand, with the exception of the threaded steel eyebolts 16, is of one-piece molded plastic.

Flexible plastic tubing 21 fits tightly over the upper end of inlet tube 19 and extends to the right where it is disconnectably but snugly attached to outlet 22 of the container 23 for reserve water. Outlet 22 discharges from container 23 just above container bottom 24. To establish a siphon of water from container 23 to the cavity in the stand one can lift water-filled container 23 using handle 26 and allow water to flow through flexible tubing 21, inlet tube 19, and into the cavity in the stand until the water level rising therein adequately covers the tip end of inlet tube 19, then one rests bottom 24 of container 23 at about the level of base ring 11 of the stand section. Additional water can be added to container 26 from time to time, taking care of course to keep the level of water therein not to reach even to quite that of eyebolts 16 in the stand (to preclude seepage).

Figure 2:
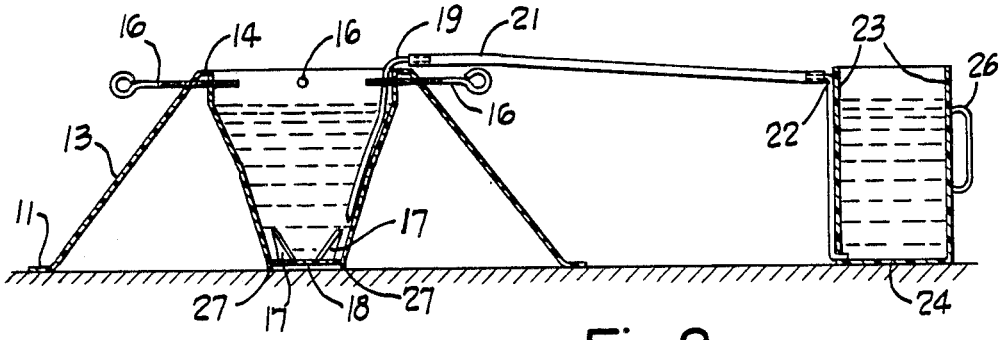
FIG. 2 is a cross-sectional elevation view through section 2—2 of FIG. 1.

Looking particularly at FIG. 2, most of the numbered items correspond to those of FIG. 1. However in FIG. 2, there can be seen annular ring 27 supporting bottom 18 of the water cavity, the base of such ring 27 and the bottom of 19½" diameter base ring 11 being at the same level. The water levels in the cavity and the container for reserve are shown in a fairly high equilibrium, and, it should be understood, that outlet 22, tubing and inlet tube 19 also are full of water so that the siphon is operating.

Raising the water level in container 23 causes the water level in the cavity of the tree stand to rise, and lowering it causes the level of cavity water to drop. Sometimes it is advantageous to have the volume of container 23 much larger than that of the stand cavity so that feeding a fair amount of water from container 23 does not affect its level greatly in the short run. Thus, having volume of container 23 at least twice and generally thrice or more that of the stand cavity (with tree base installed) is of some advantage in many instances.

Figure 3:
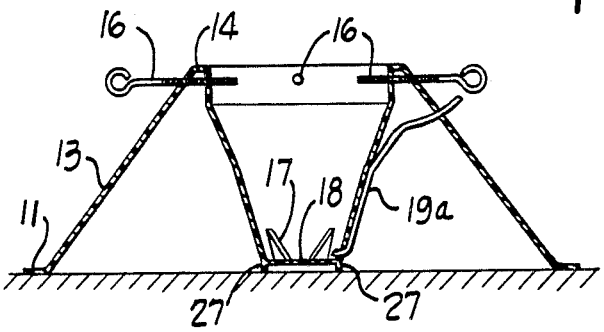
FIG. 3 shows a cross-sectional elevation of a tree stand section wherein a water inlet tube is integral with the water cavity of the stand.

Looking particularly at FIG. 3, most of the numbered items correspond to those of FIGS. 1 and 2 except that rigid plastic inlet tube 19*a* enters the water cavity of the stand near the bottom and extends through outer wall 13 for connection to a water conduit such as item 21 of FIGS. 1 and 2. Tube 19*a* is cemented to the stand where it penetrates the water cavity and outer wall 13.

Figure 4:
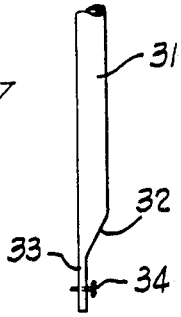
FIG. 4 is a side elevation of the end of a plastic tubing water conduit made to act as the inlet tube for attachment to the base of a severed tree.
Figure 5:
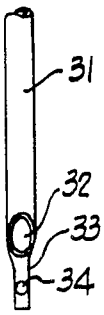
FIG. 5 is a front elevation of the same thing.

Looking particularly at FIG. 4, this shows the end of flexible plastic tubing 31 sliced to leave a tang 33 on which is fastener 34 for attaching to the bottom of the tree trunk or near to such bottom. The fastener 34 is shown as a thumb tack, but it also could be a push pin, tack, nail, screw, hook, clamp, adhesive tape, wire, or twist tie. The water discharges through hole 32 and the end of flexible tubing 31 shown serves as the inlet tube for the water cavity of a stand. FIG. 5 shows a front view of such inlet tube.

Figure 6:
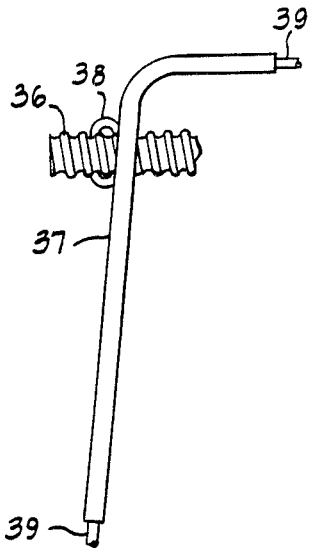
FIG. 6 shows in elevation such water inlet tube where a protective metal sleeve surrounds and guides the flexible conduit into a water-cavity and is attachable to the stand by a ring through which an eyebolt of the stand passes.

It frequently is desirable to protect the inlet tube from being crushed by a heavy tree trunk. FIG. 6 shows an inlet tube of flexible plastic tubing 39 passing through rigid tubing 37 of metal or hard plastic. Tubing 37 is equipped with ring 38 through which eyebolt 36 passes just before such eyebolt engages the tree trunk. (Such eyebolt corresponds to item 16 of FIG. 1). Thus tubing 37 not only armors the inlet tube, but also directs it downward into the cavity and holds it in place when the inner end of eyebolt 36 passes through ring 38.

Figure 7:
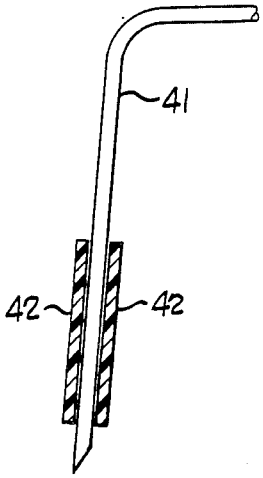
FIG. 7 shows an elevation such water inlet tube passing between two protective side guards disposed in the stand.
Figure 8:
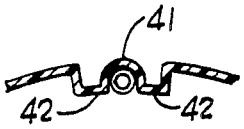
FIG. 8 shows such side guards moulded into the wall of the water cavity of the tree stand.
Figure 9:
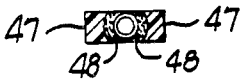
FIG. 9 shows such side guards attached to the inlet tube wall.

In FIG. 7 inlet tube 41, which can be flexible or rigid, passes through two protective sideguards 42 to guard against tube pinching, breaking, or other undesirable deformation. Such sideguards desirably often extend down even beyond the end of the inlet tube and up higher also to enhance protection of such tube. In FIG. 8 such sideguards are shown moulded into the side walls of the cavity. They could also be cemented onto such walls. In FIG. 9 sideguards 47 are cemented to the inlet tube with cement layers 48, guards 47 acting like splints and being integral with the inlet tube and the water conduit leading to it (not shown). Instead of cement, one could use wire, string, or tape (adhesive or not) to hold protective splints in place around such inlet tube. Clearly the inlet tube entering the water cavity of the stand can be unitary with the conduit, or separate therefrom and connectable thereto, and advantageously protected against pinching, breaking or other undesirable deformation.

Figure 10:
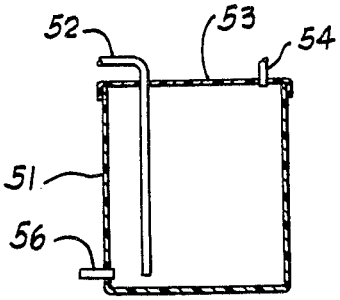
FIG. 10 shows in cross-sectional elevation a container for holding a reserve of water with outlet therefor either near the bottom or through the cover.

Looking at FIG. 10, this is water container 51 for use as a remote reservoir. The water can be fed from a flexible conduit through outlet 56 or outlet 52 in lid 53. Outlet 54 is a vent and can also be used to fill container 51. It is of advantage at times to have lid 53 fit snugly—it precludes pets, etc., from disturbing the container.

Figure 11:
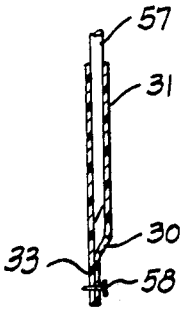
FIG. 11 is a view in cross-sectional elevation of a flexible inlet tube protected against deformation by insertion of a metal tube near its end.

Looking at FIG. 11, flexible plastic tube 31 ends in opening 30 and tang 33 with tack fastener 58 through the tang. Inside tube 31 is steel tube 57 to protect tube 31 from pinching. This unit can serve as a water inlet to the stand cavity when tubing 57 is attached to a flexible water conduit not shown. Such conduit advantageously is a rubber or plastic tube.

I claim:

1. A Christmas tree stand and irrigation device comprising a reservoir and a conduit leading therefrom, said conduit comprising a flexible tube portion extending from the reservoir and terminating in a crush-resistant end which extends into a tree base holding cup and is attachable thereto or to the tree base itself, said crush-resistant end lying closely adjacent to the cup inner wall and extending to a point near to the cup bottom.

2. A Christmas tree irrigation device consisting essentially of a reservoir and a conduit leading therefrom for supplying water to the base of a Christmas tree which is held in a stand having an open-topped, water-retaining cup around said tree base, said conduit comprising flexible tubing that terminates in an inlet tube adapted for insertion deeply into said cup from its top between the inside wall thereof and said tree base, said inlet tube being crush-resistant and equipped with means for holding it in place inside said cup, said reservoir having a pouring handle, an outlet near its bottom, and a conduit extending upwardly therefrom and being connected to said flexible tubing at the upper end of said reservoir whereby establishment of siphon action from said reservoir is facilitated.

* * * * *